United States Patent [19]

Gordon et al.

[11] 3,991,565

[45] Nov. 16, 1976

[54] SOLID PROPELLANT WITH INHIBITOR LAYER IN ROCKET MOTOR

[75] Inventors: Stuart Gordon, Cleobury Mortimer; Geoffrey Ian Evans, Bewdley, both of England; Philip Graham Jones, Maribyrnong, Australia

[73] Assignee: Imperial Metal Industries (Kynoch) Limited, Birmingham, England

[22] Filed: Mar. 12, 1969

[21] Appl. No.: 808,044

[30] Foreign Application Priority Data

Mar. 28, 1968 United Kingdom ..... 14960/68

[52] U.S. Cl. ..... 60/255; 86/1 R; 149/2; 102/103; 264/3 R

[51] Int. Cl.[2] ..... F02K 9/04; F42B 1/00

[58] Field of Search ..... 102/103; 86/1; 149/2, 149/19, 19.3, 19.9, 19.7, 19.1, 19.5, 19.6; 264/3 R; 60/253, 255, 200 A

[56] References Cited

UNITED STATES PATENTS

| | | | |
|---|---|---|---|
| 3,054,253 | 9/1962 | Chung | 102/103 X |
| 3,157,127 | 11/1964 | Proell | 102/103 |
| 3,347,047 | 10/1967 | Hartz et al. | 102/103 X |
| 3,426,528 | 2/1969 | Mangum et al. | 60/255 |
| 3,433,158 | 3/1969 | Pierce | 86/1 X |
| 3,496,870 | 2/1970 | Fulmer | 102/103 |

*Primary Examiner*—Edward A. Miller
*Attorney, Agent, or Firm*—Cushman, Darby & Cushman

[57] ABSTRACT

A method of inhibiting combustion of some of the surfaces of a solid propellant charge for or in a rocket motor comprising bonding to said surfaces an elastomeric compound resistant to permeation by combustible components of the charge, and bonding a combustion inhibiting cellulosic derivative to the elastomeric compound, the cellulosic derivative being spaced from said surfaces by the elastomeric compound. The invention also relates to a rocket motor provided with a solid propellant charge inhibited in accordance with the method.

6 Claims, No Drawings

SOLID PROPELLANT WITH INHIBITOR LAYER IN ROCKET MOTOR

BACKGROUND OF THE INVENTION

This invention relates to the inhibition of combustion of some surfaces of solid propellant charges for or in rocket motors, and is concerned with methods of providing such inhibition and solid propellant charges which are so inhibited.

Rocket motors can be provided with charges of solid propellant in either of two ways. The first of these is by the preparation, externally of the case of the motor, of a solid propellant grain which is subsequently inserted in the combustion chamber in the case, whereby the motor is said to be "cartridge loaded". The second of these is by the casting of the propellant within the combustion chamber, the wall of the combustion chamber which is usually the case of the motor, acting as the whole or part of the mould, and the propellant bonding to the wall, whereby the motor is said to be "case bonded".

For cartridge loaded rocket motors, virtually all of the surfaces of the solid propellant grain are exposed to the environment of the rocket combustion chamber, so that it is usually desirable to inhibit combustion at some of the surfaces. Often inhibition is also required for some of the otherwise exposed propellant surfaces of a case bonded rocket motor.

Cellulose derivatives, typically esters and ethers such as cellulose acetate and ethyl cellulose, have been used for many years for inhibiting combustion. However, they suffer from the disadvantage that, when used for inhibiting the combustion of solid propellants containing nitro glycerine or other nitric esters and/or plasticizers, they absorb nitro glycerine or such other nitric esters or plasticizers during storage of the solid propellant grain or case bonded rocket motor, and eventually become highly combustible themselves, whereby inhibition becomes ineffective. In addition, the absorbed nitro glycerine, nitric esters or plasticizers cause swelling, softening and loss of rigidity whereby, during combustion of the propellant concerned, the overall mechanical rigidity of the charge, depending as it does to a considerable extent on the rigidity of the inhibitor, decreases progressively to such an extent that charge deformation occurs causing contraction of the conduit area. The result is usually failure of the motor, arising from the increased pressure which is consequent upon the conduit cross-sectional area becoming less than the nozzle throat area and so effectively acting as a choke. Further such swelling and softening of the cellulosic inhibitor material renders it prone to erosion by hot gas flow within the rocket motor chamber, leading to progressive exposure of propellant surface in an unpredictable, uncontrolled fashion with consequent uncontrolled rises in motor pressure.

If cellulose derivatives are replaced by elastomeric material and this is used as the inhibiting material, during combustion inhibiting material which is no longer supported by propellant will readily be displaced from its original configuration and will then exert peeling forces on inhibiting material still bonded to and inhibiting the combustion of propellant surfaces. The peeling forces frequently result in the pulling away of large areas of inhibiting material from the surfaces of unburnt propellant, whereby these surfaces become free to combust. Failure will usually result.

Thus it is an object of the invention to provide an improved method of inhibiting solid propellant surfaces.

SUMMARY OF THE INVENTION

In accordance with the invention, a method of inhibiting combustion of some of the surfaces of a solid propellant charge for or in a rocket motor comprises bonding to said surfaces an elastomeric compound resistant to permeation by combustible components of the charge, and bonding a combustion inhibiting cellulosic derivative to the elastomeric compound, the cellulosic derivative being spaced from said surfaces by the elastomeric compound.

In accordance with the invention also a solid propellant charge for or in a rocket motor and provided on its surfaces to be inhibited from combustion with combustion inhibiting means, said combustion inhibiting means comprising bonded to said surfaces an elastomeric compound resistant to permeation by combustible components of the charge, and bonded to the elastomeric compound a combustion inhibiting cellulosic derivative, the cellulosic derivative being spaced from said surfaces by the elastomeric compound.

Preferably the cellulosic derivative is a cellulose ester or a cellulose ether.

Preferably also the cellulosic derivative is cellulose acetate or ethyl cellulose.

The combustion inhibiting cellulosic derivative may be bonded to the elastomeric compound prior to bonding of the latter to the solid propellant charge or the elastomeric compound may be bonded to the solid propellant charge prior to bonding to the combustion inhibiting cellulosic derivative.

The elastomeric compound may be bonded directly to said surfaces of the solid propellant charge, or the propellant may be cast into a mould of which at least some of the surfaces consist of the combustion inhibiting elastomeric compound, whereby some of the surfaces of the resulting solid propellant charge are bonded to the elastomeric compound.

The term "elastomeric compound" as used in this specification denotes an elastomer possessing the following properties:

1. Compatibility with the solid propellant.
2. Low solubility for combustible components of the solid propellant, for example for nitro glycerine and other liquid nitric esters and plasticizing ingredients if cast double-base propellants are used.
3. Non-combustibility in, and resistance to erosion by, the propellant combustion gases.
4. Possessing thermal capacity, conductivity and expansion of the same order as those of the propellant.
5. Permeability to propellant decomposition gases which are evolved during storage.
6. Capability of being bonded to the propellant.
7. Readily formable.
8. Elastomeric to adapt to physical and mechanical behaviour of the propellant.

Suitable elastomeric compounds include butyl rubbers, modified chlorosulphonated polyethylene, such as the "Hypalon" (Trade Mark) rubbers manufactured by E. I. du Pont de Nemours & Co., and modified ethylene propylene terpolymers, such as the "Royalene" (Trade Mark) rubbers manufactured by the U.S. Rubber Co.

All of these materials are compatible with double-base propellants and are able to follow the expansion and contraction of propellants over a wide temperature range, partly because of their high extensibility and partly because of a coefficient of thermal expansion similar to that of the propellant.

Erosion resistance may be provided for the elastomeric compound by filling with flame retarding materials, such as silica or antimony oxide, and, particularly in the case of the "Hypalon" rubbers, by enhancing the degree of cross-linking in the polymer by vulcanising with sulphur-containing compounds. All types are sufficiently permeable to propellant decomposition gases to prevent their slow evolution during storage from causing the elastomeric compound to form blisters and hence cause local rupturing of the propellant/elastomer bond.

It will be appreciated that the elastomeric compound serves principally as a barrier to the ingress of nitro-glycerine from double-base solid propellant into the cellulosic derivative inhibitor which is bonded to the elastomeric compound. For example, "Hypalon" will only absorb 3 to 5% of its own weight of nitro-glycerine and this is virtually negligible when compared with the greater than 100% absorption by cellulose acetate.

DESCRIPTION OF THE PREFERRED EMBODIMENTS

For a cartridge loaded rocket motor, the propellant grain can first be prepared, followed by the application to the surfaces thereof to be inhibited of the layers of elastomeric compound and cellulosic derivative. However, even for a cartridge loaded rocket motor, as well as a case-bonded rocket motor, it is preferred to cast the propellant within the inhibiting material.

Thus typically an elastomeric/cellulosic composite structure is prepared by coating the mutually bonding surfaces of tailored elastomeric and cellulosic materials with appropriate resins such as a phenol formaldehyde resin, for example that available under the trade mark "Redux 775" from Bonded Structures Limited, or an epoxy resin such as that available under the trade mark "Epon 828" from Shell Chemicals Limited, or a polyester resin. The elastomeric compound is conveniently in the form of calendered sheet or in the form of a moulding. The cellulosic derivative material is in the form of continuous sheet or foil, as a pre-formed tube, or as an appropriate moulded form.

The elastomeric compound may have applied to its exposed surface, i.e. that subsequently intended to be bonded to the propellant charge, a duplex resin layer of phenol formaldehyde/polyvinyl formal or of the polyvinyl formal type by itself. These resins are available under the trade marks "Redux/Formvar" and "Formvar", respectively, from Bonded Structures Limited.

The mutually bonding surfaces of the elastomeric and cellulosic materials are laid together in a suitable mould. The final composite structure is bonded together, joints are made and vulcanisation of the elastomer is effected to improve erosion resistance and general mechanical properties. The "Formvar" is prepared for subsequent bonding to propellant by the application of heat at 60°–180° C, preferably 150°–160° C and of pressure greater than 50 psi, preferably 60–100 psi.

The article so moulded provides a pre-formed inhibitor into which propellant, and particularly double base propellant, is cast by techniques well known to those versed in the art.

Alternatively elastomeric compounds and cellulosic derivative compounds may be separately pre-formed to any desired shape by suitable known moulding or other forming and shaping techniques and bonded together by the application of suitable resins, such as phenol formaldehyde resins, epoxy resins and polyester resins, to provide composite cellulosic/elastomeric structures. These are prepared for bonding to propellant by appropriate adaptation of the above described techniques. This provides inhibition for surfaces which may be of complicated shape and curvature which is not readily achievable by other means.

The elastomeric compound, as well as preventing permeation of nitro-glycerine to the cellulose acetate, serves to insulate the latter to some degree from the high temperatures developed during the firing of a rocket motor. This also assists in maintaining rigidity of the cellulose acetate, and the fact that virtually no nitro-glycerine is absorbed by the cellulose acetate ensures that the softening effect of nitro-glycerine will not occur. To exemplify this, it has been found that the tensile strength of cellulose acetate is of the order of 5,000–7,000 psi whereas continued storage in direct contact with double base propellant, whereby nitro-glycerine is absorbed, reduces the tensile strength to about 1,000 psi. For elongation without nitro-glycerine the maximum elongation of cellulose acetate is 30–40% whereas with nitro-glycerine the elongation is from 50–100%.

To assess the success of the present invention, solid propellant grains were prepared of which some were inhibited by cellulose acetate alone, and others by the composite inhibition of cellulose acetate plus "Hypalon" as a barrier as described above. After three months of continuous storage at 140° F, the grains coated only with cellulose acetate failed on firing in a rocket motor case because the rigidity of the cellulose acetate and its combustibility had changed to such a degree that the cellulose acetate combusted and parts of the cellulose acetate left unsupported by the burning of the solid propellant were displaced from their usual configuration. In contrast, grains provided with composite inhibition of cellulose acetate plus "Hypalon" as a barrier as described could still be fired completely successfully after 18 months storage at 140° F.

The invention has been described with relation to cartridge loaded rocket motors, but it is also applicable to case bonded rocket motors. Thus typically a case bonded rocket motor has a central conduit providing communication with the nozzle of the rocket from combustion surfaces at the head end of the rocket motor. With the present invention the surface of this conduit can be successfully inhibited from combustion.

We claim:

1. A rocket motor of the type including a case, a solid propellant charge and a layer of combustion inhibiting cellulosic derivative on some of the surfaces of the propellant charge, wherein the improvement comprises the inclusion of layer of an elastomeric compound resistant to permeation by combustible components of the propellant charge bonded between said propellant surfaces and the layer of cellulosic derivative with a layer of phenol formaldehyde and polyvinyl formal resin and between the elastomeric layer and the layer of cellulosic derivative by a resin.

2. The rocket motor of claim 1 wherein said combustion inhibiting cellulosic derivative is bonded to said elastomeric compound by a phenol formaldehyde resin.

3. The rocket motor of claim 1 wherein said combustion inhibiting cellulosic derivative is bonded to said elastomeric compound by an epoxy resin.

4. The rocket motor of claim 1 wherein said combustion inhibiting cellulosic derivative is bonded to said elastomeric compound by a polyester resin.

5. The rocket motor of claim 1 wherein the said surface of said solid propellant charge is bonded to said elastomeric compound by casting of the propellant charge in a mould, the surface area of the mould corresponding to the said surface of the charge being constituted by said elastomeric compound having said layer of resin thereon.

6. A method of inhibiting combustion of some of the surfaces of a solid propellant charge in a rocket motor comprising bonding an elastomeric compound which is resistant to permeation by combustible components of the charge to said surfaces with a resin layer of phenol formaldehyde and polyvinyl formal, and bonding a combustion-inhibiting cellulose derivative to the elastomeric compound with a resin so that said cellulosic derivative is spaced from said surfaces by said elastomeric compound.

* * * * *